US005679006A

United States Patent [19]

Madelaine

[11] Patent Number: 5,679,006

[45] Date of Patent: Oct. 21, 1997

[54] MULTICHANNEL ELECTRICAL CONNECTOR WITHOUT AND ELECTRO-MAGNETIC BARRIER BETWEEN THE CHANNELS

[75] Inventor: Alain Louis Marcel Madelaine, Voiron, France

[73] Assignee: Radiall, Rosny Sous Bois, France

[21] Appl. No.: 545,449

[22] Filed: Oct. 19, 1995

[30] Foreign Application Priority Data

Oct. 19, 1994 [FR] France ..... 94 12479

[51] Int. Cl.[6] ..... H01R 9/09

[52] U.S. Cl. ..... 439/63; 439/608

[58] Field of Search ..... 439/63, 581, 608, 439/79, 80

[56] References Cited

U.S. PATENT DOCUMENTS

| | | | |
|---|---|---|---|
| Re. 32,691 | 6/1988 | Dola et al. | 439/608 OR |
| 3,971,618 | 7/1976 | Prince | 439/608 OR |
| 4,842,527 | 6/1989 | Tellman . | |
| 4,900,258 | 2/1990 | Hnatuck . | |
| 5,055,069 | 10/1991 | Townsend . | |
| 5,516,307 | 5/1996 | Cartesse et al. | 439/63 X |

FOREIGN PATENT DOCUMENTS

| | | |
|---|---|---|
| 0488482 | 3/1992 | European Pat. Off. . |
| 0561202 | 9/1993 | European Pat. Off. . |
| 3904461 | 9/1990 | Germany . |

*Primary Examiner*—P. Austin Bradley
*Assistant Examiner*—Daniel Wittels
*Attorney, Agent, or Firm*—Schweitzer Cornman Gross & Bondell LLP

[57] ABSTRACT

The invention relates to a multichannel electrical connector, each channel consisting of a coaxial contact element including a central conductor and an outer conductor, means of connection to a printed-circuit board and an electrically conducting pin connecting the central conductor of the coaxial contact element to the said connection means.

The conducting pins (7) are housed in a case (3, 12) which defines a continuous internal space, each conducting pin (7) being located close to at least one earth plane (13, 14) and being separated from the adjacent conducting pin or pins by a distance greater than the distance separating it from its earth plane (13, 14).

15 Claims, 2 Drawing Sheets

MULTICHANNEL ELECTRICAL CONNECTOR WITHOUT AND ELECTROMAGNETIC BARRIER BETWEEN THE CHANNELS

BACKGROUND OF THE INVENTION

The present invention relates to a multichannel electrical connector without an electromagnetic barrier between the channels.

Miniature multichannel electrical connectors are already known, each channel consisting of a coaxial contact element including a central conductor and an outer conductor, means of connection to a printed-circuit board and an electrically conducting pin connecting the central conductor of the coaxial contact element to the said connection means.

In these known connectors, conducting pins of the various channels are separated in pairs by a conducting partition whose function is to isolate them from the electromagnetic standpoint in order to prevent any crosstalk between the signals carried by two adjacent pins.

Such connectors are generally satisfactory, but they have a few drawbacks.

In particular, their manufacture poses a problem on account of the fact that the partitions which separate the various conducting pins define channels inside the connector and that it is difficult, especially when the connector is a right-angled connector, to introduce the conducting pins into these channels.

Furthermore, production of such partitions means that the manufacturing cost of the connectors is relatively high.

In addition, these partitions constitute an obstacle to the miniaturization of the connector, which must necessarily have n-1 partitions for n pins, hence requiring a certain amount of space.

The aim of the present invention is to provide a multichannel electrical connector which does not have in particular the drawbacks mentioned hereinabove.

SUMMARY OF THE PRESENT INVENTION

The subject of the present invention is a multichannel electrical connector in which each channel consists of a coaxial contact element including a central conductor and an outer conductor, means of connection to a printed-circuit board and an electrically conducting pin connecting the central conductor of the coaxial contact element to the said connection means, characterized in that the conducting pins are housed in a case which defines a continuous internal space, each conducting pin being located close to at least one earth plane and being separated from the adjacent conducting pin or pins by a distance greater than the distance separating it from its earth plane.

Thus, essentially all the electromagnetic radiation from each conducting pin is picked up by the earth plane before reaching the adjacent conducting pin or pins.

It may be understood that the connector according to the invention has the advantage of being able to be miniaturized to a great extent, while having a relatively low manufacturing cost.

In a preferred embodiment of the invention, the conducting pins are housed in a dielectric medium whose dielectric constant is defined, so that, given the diameter of each pin and the distance separating this pin from its earth plane or planes, the impedance of each channel has a desired value.

In a variant of this embodiment, the connector includes a second dielectric medium, of different dielectric constant, which separates the first dielectric medium from the earth plane or planes.

For example, the conducting pins can be placed in a first dielectric medium consisting of air and can bear against a layer of plastic applied to the earth plane, this layer of plastic constituting a second dielectric medium.

In accordance with the invention, the case is made preferably of an electrically conducting material and acts as a screen with respect to the outside.

In a first embodiment of the invention, a single earth plane is provided which preferably consists of one wall of the case and in the vicinity of which the conducting pins are located.

In a second embodiment of the invention, two parallel earth planes are provided which preferably consist of two walls of the case and between which the conducting pins are located.

With the purpose of making the invention better understood, three embodiments will now be described, these being given by way of non-limiting examples, with reference to the appended drawing in which:

DETAILED DESCRIPTION OF THE INVENTION

Figure 1:
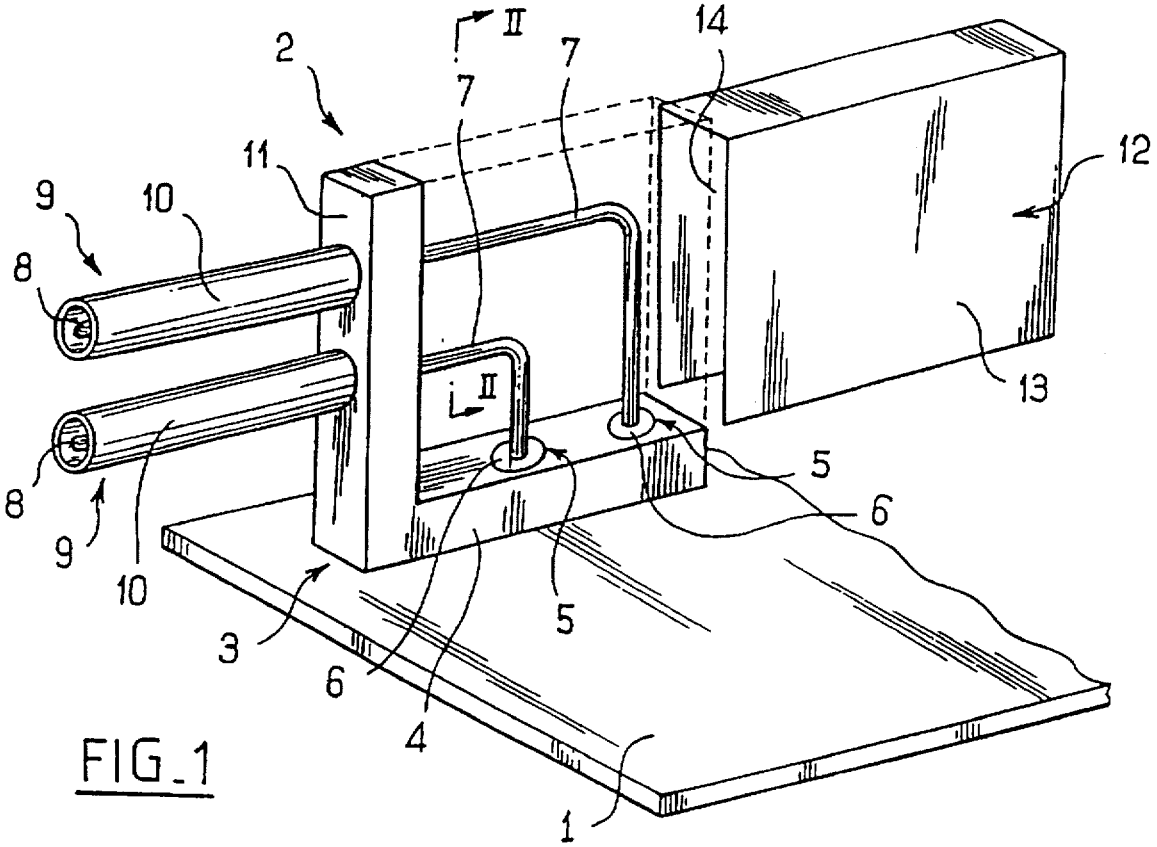
FIG. 1 is a perspective view of a connector according to a first embodiment of the invention.

Represented in the drawing is a printed-circuit board 1 on which is mounted a connector 2 including an L-shaped metal support 3, the lower arm 4 of which is fastened to the board land includes drill-holes 5 fitted with insulating sleeves 6 through which the ends of two right-angled conducting pins 7 are engaged.

The metal support 3 and the ends of the conducting pins 7 are fixed to the printed-circuit board 1 by conventional means, especially by soldering.

Each conducting pin 7 is connected to the central conductor 8 of a coaxial contact element 9, the outer conductor 10 of which is soldered to the upper arm 11 of the metal support 3.

A metal cover 12 of parallelepipedal shape, including an open bottom and an open front face, is mounted in a removable manner on the metal support 3 by fixing means, not shown, in order to constitute a case in the sense of the invention.

This case defines a continuous internal space in which the two conducting pins 7 are housed.

Figure 2:
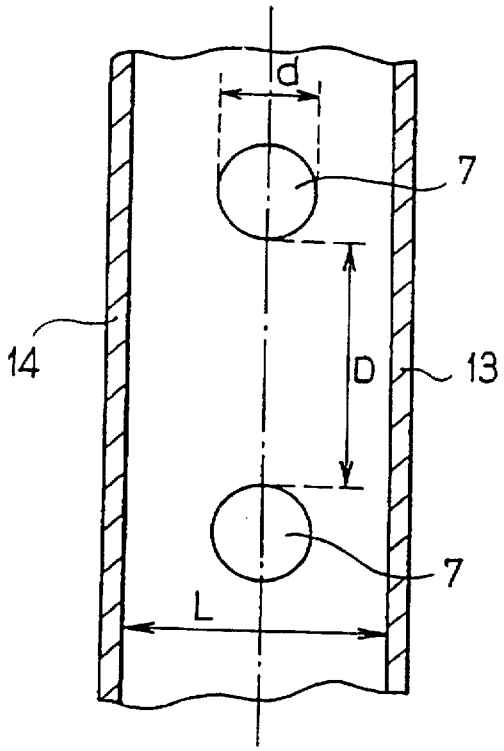
FIG. 2 is a sectional view along II—II of FIG. 1.

As may be seen in the sectional view in FIG. 2, the two large faces 13, 14 of the cover 12 constitute parallel earth planes separated by a distance L=1.1 mm.

The two conducting pins 7 are placed between these two earth planes. The external diameter d=0.6 mm of each conducting pin 7 and the dielectric constant K=1 of air, which here forms the single dielectric medium in which the conducting pins are placed, enable the impedance Z of each line to be determined by applying the following approximate formula:

$Z=60/K^{1/2}\ln(4L/\pi d)\sim 50\Omega$

The conducting pins 7 are separated from each other by a distance D equal to 4 mm.

Thus, for alternating signals having a frequency between approximately 100 MHz and 18 GHz, and a power between approximately 0.1 and 10 W, less than 30 dB crosstalk is observed between the channels, which may be regarded as negligible.

Figure 3:
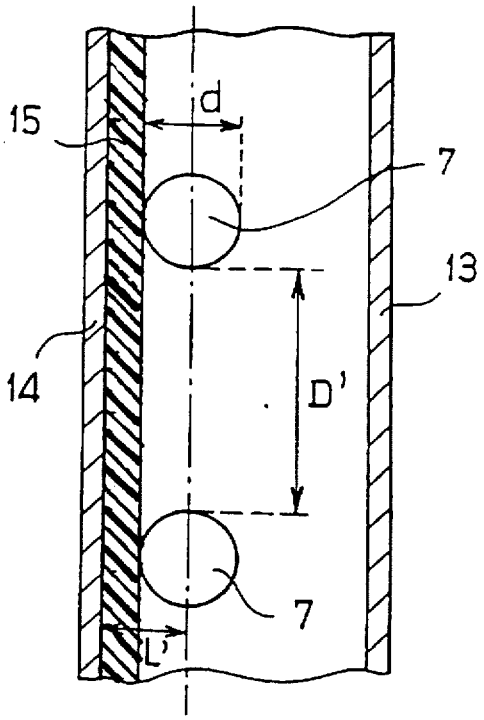
FIG. 3 is a view similar to FIG. 2 of a connector according to a second embodiment of the invention.

In the embodiment shown in FIG. 3, the conducting pins 7 are situated close to one of the walls 14 of the metal cover.

The distance separating the conducting pins 7 from the other wall 13 of the metal cover is sufficiently large so that the influence of this other wall 13 on the conducting pins 7 can be regarded as negligible, or indeed zero, from the electromagnetic standpoint.

Nevertheless, the cover 12 fulfills a screening function with respect to the outside, as in the previous embodiment.

In this embodiment of FIG. 3, a second dielectric material 15 consisting of a layer of PTFE (polytetrafluoroethylene) whose dielectric constant K2 is 2, has been provided in addition to the air cavity of dielectric constant K1=1 in which the conducting pins 7 are placed.

If the distance L' separating the axis of each conducting pin from the earth plane is approximately 0.5 mm, the impedance Z of each electrical line is approximately 50 Ω.

In this embodiment, the conducting pins are separated by a distance D'=4 mm.

In this case, for signals whose power is a maximum of 10 W, and whose frequency is between 100 MHz and 18 GHz, less than 30 dB coupling is observed between the channels, which my be regarded as negligible.

Moreover, it may be noted that the second dielectric medium 15 provides an advantage regarding the manufacture of the case 12 by constituting a spacer which makes it possible to position the conducting pins 7 at a desired distance from the earth plane 14 by applying them against this layer 15.

Figure 4:
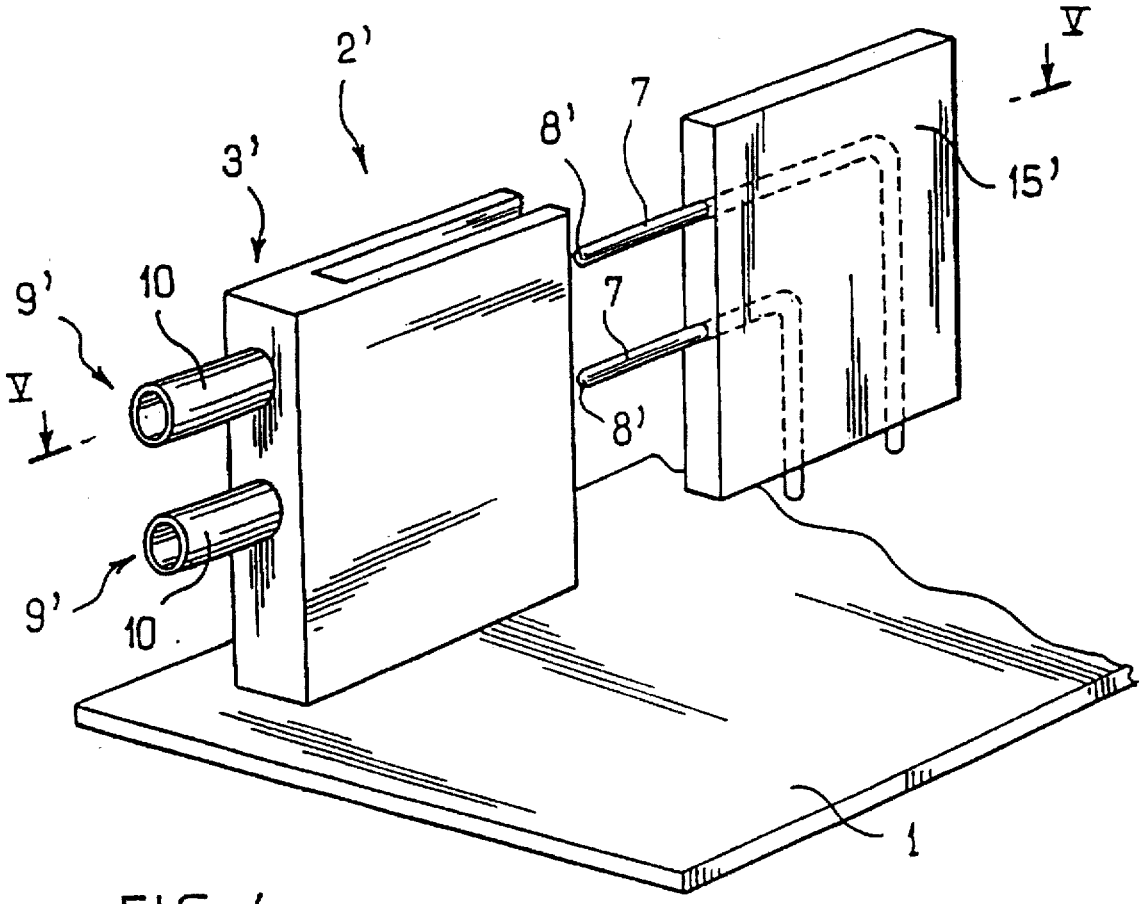
FIG. 4 is a perspective view of a connector, in the dismounted state, according to a third embodiment of the invention.
Figure 5:
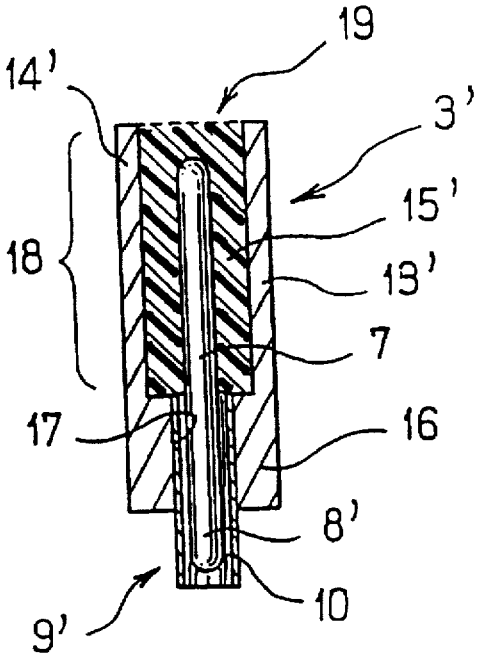
FIG. 5 is a sectional view along V—V of FIG. 4 of the connector in the mounted state.

In the third embodiment, shown in FIGS. 4 and 5, the connector 2' includes a metal case 3' which has, in a plane parallel to the printed circuit 1, a U-shaped cross-section as may be seen in FIG. 5.

In its front part 16, which forms the base of the U in FIG. 5, the case 3' is solid and includes two bores 17 in which the outer conductors 10 are engaged, these outer conductors 10 being soldered or forcibly inserted into the bores 17.

In its rear part, which forms the two arms of the U in FIG. 5, the case 3' includes two parallel plane walls 13', 14'.

The rear end 19 of the case 3' is open.

A block 15' of dielectric material, for example made of polyamide, is provided over the conducting pins 7 by molding.

The dimensions of the block 15' correspond substantially to the internal dimensions of the space between the walls 13' and 14' of the case 3'.

The block 15' is intended to be inserted into the case 3' between its two parallel walls 13' and 14', as may be seen in FIG. 5.

Each conducting pin 7 engages inside the corresponding outer conductor 10 and its end 8' directed towards the front part 18 of the case constitutes the central conductor of a coaxial contact 9' thus produced.

Once the block 15' has been inserted into the case 3', the rear face 19 of the case can be closed off by an electrically conducting plate, not shown, intended to constitute an electromagnetic screen with respect to the outside of the case.

It is quite understood that the embodiments which have just been described have no limiting character and that it will be possible to make any desirable modification to them without thereby departing from the scope of the invention.

I claim:

1. A multichannel electrical connector, each channel comprising a coaxial contact element including a central conductor and an outer conductor, means of connection to a printed-circuit board and an electrically conducting pin (7) connecting the central conductor of the coaxial contact element to said connection means, wherein the conducting pins (7) of the channels are housed in a case (3, 12; 3') which defines a continuous internal space, each of said conducting pins (7) being located close to and associated with at least one earth plane (13, 14; 13', 14') and being separated from the adjacent conducting pin (7) by a distance (D, D') greater than the distance separating it from its associated earth plane (13, 13; 13', 14').

2. A connector according to claim 1, wherein the case (3, 12; 3') includes a single earth plane (14) in the vicinity of which the conducting pins (7) are located.

3. A connector according to claim 1, wherein the case (3, 12; 3') includes two parallel earth planes (13, 14) between which the conducting pins (7) are located.

4. A connector according to claim 3, wherein the conducting pins (7) are overmoulded in a block (15') of dielectric material inserted into the case (3').

5. A connector according to claim 4, wherein the end (8') of a conducting pin (7) directed towards the corresponding coaxial contact element (9') constitutes the central conductor of this coaxial contact element.

6. A connector according to claim 1, wherein the conducting pins (7) are housed in a dielectric medium whose dielectric constant (K1) is defined, so that, given the diameter (d) of each pin (7) and the distance separating this pin (7) from the earth plane or planes (13, 14; 13',4'), the impedance (Z) of each channel has a desired value.

7. A connector according to claim 6, wherein the case (3, 12; 3') includes a single earth plane (14) in the vicinity of which the conducting pins (7) are located.

8. A connector according to claim 6, wherein the case (3, 12; 3') includes two parallel earth planes (13, 14) between which the conducting pins (7) are located.

9. A connector according to claim 8, wherein the conducting pins (7) are moulded in a block (15') of dielectric material inserted into the case (3').

10. A connector according to claim 9, wherein the end (8') of a conducting pin (7) directed towards the corresponding coaxial contact element (9') constitutes the central conductor of this coaxial contact element.

11. A connector according to claim 6, including a second dielectric medium, of different dielectric constant (K2), which separates the first dielectric medium from the earth plane or planes (14).

12. A connector according to claim 11, wherein the case (3, 12; 3') includes a single earth plane (14) in the vicinity of which the conducting pins (7) are located.

13. A connector according to claim 11, wherein the case (3, 12; 3') includes two parallel earth planes (13, 14) between which the conducting pins (7) are located.

14. A connector according to claim 13, wherein the conducting pins (7) are moulded in a block (15') of dielectric material inserted into the case (3').

15. A connector according to claim 14, wherein the end (8') of a conducting pin (7) directed towards the corresponding coaxial contact element (9') constitutes the central conductor of this coaxial contact element.

* * * * *